United States Patent [19]

Tang

[11] 4,236,779

[45] Dec. 2, 1980

[54] EMI SHIELDED CABLE AND CONNECTOR ASSEMBLY

[75] Inventor: Paul R. Tang, Broomfield, Colo.

[73] Assignee: Bunker Ramo Corporation, Oak Brook, Ill.

[21] Appl. No.: 901,380

[22] Filed: May 1, 1978

[51] Int. Cl.[3] ..... H01R 3/06

[52] U.S. Cl. ..... 339/143 R; 339/177 F; 339/156 R

[58] Field of Search ..... 339/89 C, 90 C, 91 R, 339/177 R, 177 F, 143 R, 156 R; 174/103, 104

[56] References Cited

U.S. PATENT DOCUMENTS

| | | | |
|---|---|---|---|
| Re. 28,468 | 7/1975 | Baumgartner et al. . | |
| Re. 28,837 | 6/1976 | Silva . | |
| Re. 29,246 | 5/1977 | Ricci . | |
| 3,078,436 | 2/1963 | Berry . | |
| 3,128,139 | 4/1964 | Estes . | |
| 3,281,756 | 10/1966 | O'Keefe et al. . | |
| 3,315,024 | 4/1967 | Ball . | |
| 3,391,381 | 7/1968 | Livingston . | |
| 3,564,117 | 2/1971 | Schaeffler et al. . | |
| 3,594,691 | 7/1971 | Neal . | |
| 3,689,865 | 9/1972 | Pierini . | |
| 3,701,086 | 10/1972 | Somerset | 339/89 C X |
| 3,701,839 | 10/1972 | Smith . | |
| 3,705,378 | 12/1972 | Elkins | 339/156 R |
| 3,739,076 | 6/1973 | Schwartz . | |
| 3,744,128 | 7/1973 | Fisher et al. . | |
| 3,753,204 | 8/1973 | Thompson . | |
| 3,775,732 | 11/1973 | Frogner . | |
| 3,830,957 | 8/1974 | Oberdiear . | |
| 3,845,449 | 10/1974 | Taylor . | |
| 3,866,292 | 2/1975 | Tucci . | |
| 3,876,276 | 4/1975 | Ayer | 339/156 R X |
| 3,915,540 | 10/1975 | Thompson et al. . | |
| 3,963,300 | 6/1976 | Patton et al. | 339/156 R |
| 3,963,300 | 6/1976 | Patton et al. . | |
| 3,990,765 | 11/1976 | Hill | 339/143 R X |
| 4,025,145 | 5/1977 | Schaffer et al. . | |
| 4,032,205 | 6/1977 | Taj . | |

FOREIGN PATENT DOCUMENTS

| | | |
|---|---|---|
| 752081 | 7/1956 | United Kingdom . |
| 828789 | 2/1960 | United Kingdom . |
| 912514 | 12/1962 | United Kingdom . |
| 1020903 | 2/1966 | United Kingdom . |
| 1477859 | 6/1977 | United Kingdom . |

OTHER PUBLICATIONS

IEEE STD 488-1975, IEEE Instrumentation & Measurements Group, 1975.

The Amphenol Interface Bus Cable Assembly from Bunker Ramo", Bunker Ramo Corp. Brochure.

Lo-Hi Electromagnetic Interference Control, J.W. Murphy, Aerospace & Electronic Systems, vol. 2, No. 4, Jul. 1966.

*Primary Examiner*—Howard N. Goldberg
*Assistant Examiner*—Eugene F. Desmond
*Attorney, Agent, or Firm*—F. M. Arbuckle; T. J. Haller

[57] ABSTRACT

An EMI shielded connector assembly is disclosed for terminating a shielded electrical cable. The EMI shielded cable preferably includes a plurality of conductors and electrically isolated inner and outer EMI shielding layers surrounding the conductors. The connector assembly includes a connector member having a plurality of contact elements, a mating portion for engaging a compatible connector member, and a terminal portion for terminating the cable conductors to the contact elements. A shielding element is electrically connected to the outer shielding layer of the cable and substantially surrounds the terminal portion of the connector member to provide continuous shielding of the connector member from electromagnetic interference, the shielding element being mechanically secured to the cable and to the connector member. Means are also provided for electrically connecting the inner shielding layer of the cable with one of the contact elements to thereby extend the double-shielding capability and characteristics of the cable throughout the entire connector assembly.

14 Claims, 7 Drawing Figures

EMI SHIELDED CABLE AND CONNECTOR ASSEMBLY

RELATED APPLICATIONS

U.S. Pat. Application Ser. No. 958,479, filed Nov. 7, 1978, by Earl D. Fiske and assigned to the assignee of the present invention, the contents of which are specifically incorporated herein by reference.

BACKGROUND OF THE INVENTION

This invention relates generally to EMI shielded electrical cables and connectors and more particularly to double-ended or feedthrough electrical connectors and EMI shielding thereof. Specifically, the present invention relates to a connector assembly for terminating a double-shielded electrical cable and for maintaining the integrity of the EMI double-shielding system throughout the entire connector assembly to provide total and continuous EMI shielding thereof.

Electromagnetic interference (EMI) shielded cables and connector assemblies are frequently used for the transmission of data signals between programmable instruments, such as computers and the like, as well as in other environments wherein electrical and electromagnetic radiation can be expected to interfere with the electrical signals carried by the interconnecting cables and connector assemblies. An example of such a data transfer system is disclosed in U.S. Pat. No. Re. 29,246. EMI shielding is utilized in such cables and connector assemblies to receive EMI radiation emitted by nearby instruments and cables, thereby preventing such radiation from completely penetrating the cables and connector assemblies and being received by the internal conductors and contact elements thereof. In environments containing a large number of such programmable instruments, the intensity of EMI and electrical radiation is generally high, and proper shielding of the interconnecting cables and connector assemblies is critical.

A wide variety of shielded cable and connector assembly arrangements have been developed over the years for various purposes. Such cables generally include a layer of electrically conductive material disposed about the conductors of the cable with the stray EMI radiation being received by and conducted along the separate electrical circuit of the shielding layer. Likewise, when such cables are terminated to a connector assembly, the cable's EMI shield is generally grounded to an electrically conductive connector assembly housing so as to shield the terminal portions of the conductors as well as the contact elements disposed in the connector assembly. However, in high intensity EMI radiation fields, such single layer shielding protection has generally proven inadequate. It has been shown that in such environments, some of the stray EMI and electrical radiation occasionally penetrates the single shielding layer and is received by the cable conductors and assembly contact elements, which reception interferes with the electrical signals being transmitted therealong. Furthermore, such single layered shielding protection does not adequately prevent electrical and EMI radiation emissions by the shielded cable and connector assemblies themselves, which emissions can interfere with the signals carried by other proximately disposed cables and connector assemblies.

The interconnection of programmable instruments also occasionally requires the termination of a shielded cable to a double-ended or feedthrough type connector assembly, as seen in the IEEE Standard Digital Interface for Programmable Instrumentation manual, IEEE Standard 488-1975. In this regard, it is known to provide a pair of connector members at the end of each cable which are arranged in a back-to-back relation. Examples of such double-ended connectors are illustrated in U.S. Pat. Nos. 3,705,388, 3,866,292, 3,876,276 and 3,963,300, and U.S. Pat. Application Ser. No. 798,781. However, prior to the present invention, such double-ended connector assemblies have not included EMI shielding. Therefore, even though an EMI shielded cable may adequately protect the conductors therein from stray EMI and electrical radiation, the termination of such a cable to an unshielded double-ended connector assembly substantially reduces the overall shielding capability of the cable and connector assembly unit. Thus, any shielding protection provided by the cable is substantially diminished by the termination of such a cable to an unshielded double-ended connector assembly.

SUMMARY OF THE INVENTION

Therefore, the present invention is directed to a connector assembly for terminating an EMI double-shielded cable and to an EMI shielded double-ended connector assembly which overcome the above-described deficiencies and problems of prior shielded connector assemblies and double-ended connectors.

It is one object of the present invention to provide a shielded connector assembly for terminating a shielded cable wherein the connector assembly includes a pair of back-to-back connector members adapted for mating engagement with compatible connector members in an instrument interface system.

Another object of the present invention is to provide a connector assembly for terminating an EMI double-shielded cable which is structured to extend both shield circuits of the terminated cable throughout the entire connector assembly to a compatible connector member.

It is a further object of the present invention to provide an electrical cable having electrically isolated, double EMI shield systems to protect the cable conductors from EMI interference in environments having a high intensity of stray EMI and electrical radiation.

Still another object of the present invention is to provide an EMI double-shielded cable and connector assembly for use in instrument interface systems for transferring digital data signals.

Accordingly, the present invention is directed to an EMI shielded connector assembly for terminating a double-shielded cable and more particularly to an EMI shielded double-ended connector assembly. Specifically, a connector assembly is provided for terminating an electrical cable having at least one and preferably a plurality of central conductors and electrically isolated inner and outer EMI shielding layers surrounding the central conductors. The connector assembly includes a connector member having a plurality of contact elements, a mating portion for receiving a compatible connector member, and a terminal portion for terminating the cable's central conductors to the contact elements. Means are provided for electrically connecting the inner shielding layer of the cable to at least one of the connector contact elements and preferably includes a ground conductor. In addition, shielding means are electrically connected to the outer shielding layer of the cable and arranged to substantially surround the terminal portion of the connector member for continuously shielding the connector member from electromagnetic interference. The shielding means provides a ground path from the outer shielding layer to an engaged compatible connector member, while a ground path for the inner shielding layer is provided along the separate circuit of the ground conductor through the interconnected contact element to the engaged compatible connector member.

In one form of the invention, the connector assembly includes a double-ended connector member having a pair of spaced back-to-back connectors, the terminal portions of the connectors being directed toward each other. Respective contact elements of each connector terminal portion are interengaged by intermediate conductors disposed in the space between the connectors. The double-ended connector assembly also includes an EMI shielding element electrically connected to the outer shielding layer of the cable and which forms an envelope surrounding the terminal portions of the paired connectors and the space therebetween, thereby shielding the connectors from stray EMI and electrical radiation. It should be noted that this embodiment of the invention may be utilized to terminate either single or double-shielded cables.

BRIEF DESCRIPTION OF THE DRAWINGS

The novel features which are believed to be characteristic of the present invention are set forth in the appended claims. The invention itself however, together with further objects and advantages thereof, will become apparent and best understood by reference to the following detailed description taken in connection with the accompanying drawings, setting forth by way of illustration and example certain embodiments of the invention in the several figures of which like reference numerals identify like elements, and in which:

DETAILED DESCRIPTION OF THE PREFERRED EMBODIMENT

The EMI shielded connector assembly of the present invention is particularly unique in at least two respects. In one form, the connector assembly of the present invention provides a unique shielded connector member for terminating a double-shielded electrical cable. When the connector assembly is in its double-ended form, as described in greater detail below, it provides a novel double-ended shielded connector capable of terminating either single or double-shielded electrical cables.

Figure 1:
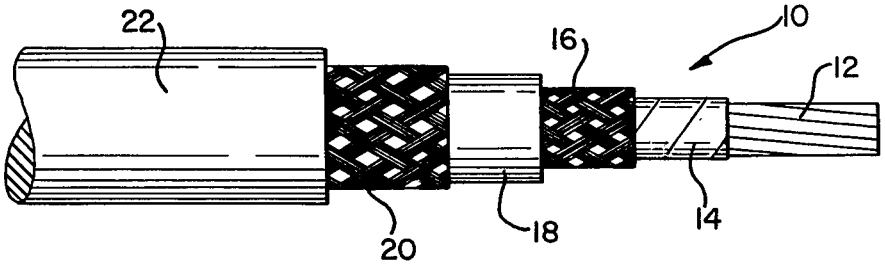
FIG. 1 is a fragmentary side elevation view of a double EMI shielded cable utilized with the connector assembly of the present invention.

Referring now to FIG. 1, a shielded electrical cable 10 is illustrated wherein the cable 10 includes two layers of EMI shielding. More specifically, the cable 10 includes at least one and preferably a plurality of centrally disposed, bundled electrical conductors 12. While the conductors 12 may be non-insulated, each conductor 12 is preferably individually insulated to provide the cable 10 with a plurality of electrical circuit or signal paths. An electrically insulating binding tape 14 is wrapped about the bundle of conductors 12 to bind them into a substantially cylindrical unit. The tape 14 may be formed from any appropriate electrically insulating material and is preferably ethylene terephthalate, more commonly known under the trade names of Mylar, Dacron, Cronar or Terylene.

Disposed about the binding tape 14 is an inner layer of EMI and electrical shielding material 16. The inner EMI shielding layer 16 is preferably constructed from an electrically conductive braided metal such as a tin-copper alloy. The braided construction is utilized to provide the inner EMI shielding layer 16 with a substantial degree of flexibility. An inner jacket 18 surrounds the inner EMI shielding layer 16 and is composed of a layer of electrically insulating material such as polyvinyl chloride (PVC) or the like. The inner jacket 18 completely surrounds the inner shielding layer 16 in a substantially cylindrical form so as to electrically isolate the inner shield 16. Thus, the inner EMI shielding layer 16 provides an isolated electrical path when electrically connected to ground at one end.

Surrounding the inner jacket 18 is an outer layer of EMI and electrically shielding material 20. The outer EMI shielding layer 20 is also preferably formed from electrically conductive braided metal such as tin-copper alloy, thereby permitting cable 10 to be relatively flexible. Disposed about the outer shield 20 is an outer sheath 22 formed from any suitable electrically insulating material, such as PVC. The outer sheath 22 provides protection from the environment as well as electrically isolates the outer shield 20 between the inner jacket 18 and the sheath 22. The outer EMI shielding layer 20 thus provides a second isolated electrical path when electrically connected to ground at one end.

The shielding layers 16 and 20 prevent the conductors 12 from receiving stray electromagnetic and electrical radiation from the environment surrounding the cable 10 which interferes with the electrical current or signal being carried by the conductors 12. When the cable 10 is utilized for interconnecting instruments in programmable instrumentation systems, such as computer systems, it is essential that the digital data signals carried by each conductor 12 remain stable and non-fluctuating, and interference by stray electromagnetic radiation will fluctuate and change such signals. Therefore, in environments containing a number of such programmable instruments wherein the intensity of stray EMI and electrical radiation is particularly high, a single layer of electrical shielding about the conductors 12 is generally insufficient. The cable 10, however, includes a double-shielding system comprising the electrically isolated layers 16 and 20. The outer EMI shielding layer 20 provides overall EMI shielding protection by absorbing the majority of EMI radiation frequencies to which the cable 10 is subjected. Such stray frequencies are received by and carried along the circuit path of the shielding layer 20. The shielding layer 16, which has a circuit path electrically separate from that of the shielding layer 20, receives the residual EMI radiation frequencies which pass through the shielding layer 20. Thus, the inner shielding layer 16 provides final signal protection for the conductors 12. Furthermore, the inner shielding layer 16 receives and carries along its circuit path stray EMI and electrical radiation emanating from the conductors 12, thereby preventing signal leakage from the cable 10. This reduces the overall intensity of stray EMI and electrical radiation in the surrounding environment as well as enhances the signal strength of the conductors 12.

In addition, tests have indicated that due to the electrical isolation of the inner and outer shielding layers 16 and 20 and the distance therebetween, the layers 16 and 20 produce a capacitance effect on the signals carried by the conductors 12 so as to provide the cable 10 with electrical characteristics different from the expected doubling effect of the double EMI shield arrangement. This synergistic effect resulting in part from the capacitance between the inner and outer shielding layers 16 and 20 provides the cable 10 with characteristics particularly useful in the interconnection of programmable instruments.

Figure 2:
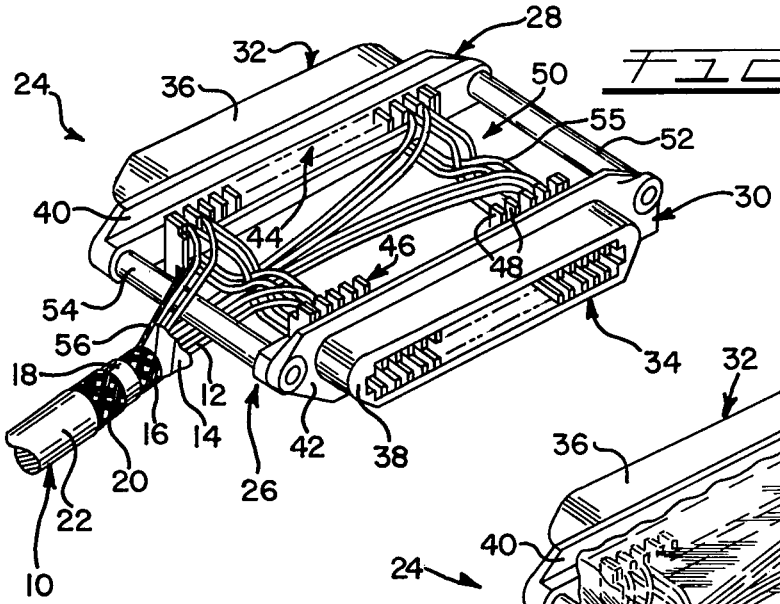
FIG. 2 is a perspective view of a double-ended connector assembly of the present invention illustrating the connector assembly in a partially assembled state with the cable of FIG. 1 being terminated thereto.
Figure 3:
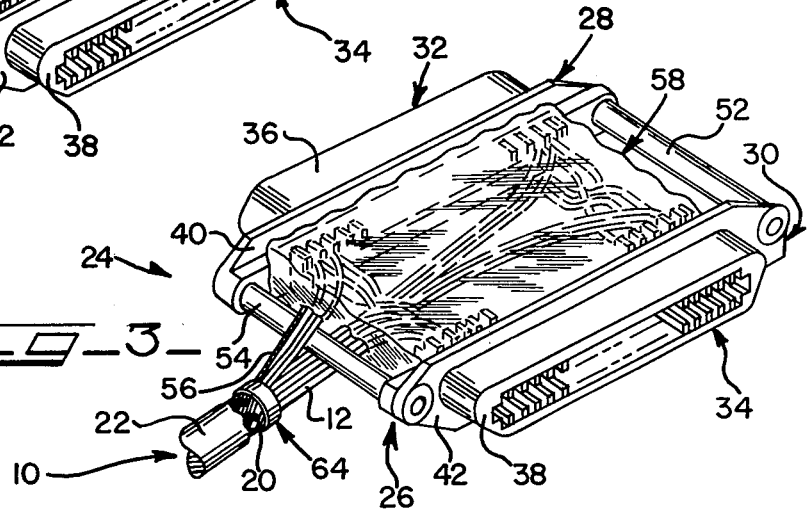
FIG. 3 is a perspective view similar to FIG. 2 but illustrating a second stage of assembly with the shielding means attachment structure in place about the terminal portion of the shielded cable.

Referring to FIGS. 2 and 3, an EMI and electrically shielded connector assembly 24 is shown with the EMI shielded cable 10 being terminated therein. In the preferred form, the connector assembly 24 includes a connector member 26 having back-to-back connectors 28 and 30. The connectors 28 and 30 may be both of the same character, i.e., both male or female, or they may be one male and one female in a known manner. In the illustrated form, the connector 28 is a male connector while the connector 30 is a female connector. Each of the connectors 28, 30 includes, respectively, a mating portion 32 and 34 which include electrically conductive housings 36 and 38 having respective mounting ledges 40 and 42. Each connector 28, 30 also includes a terminal portion 44 and 46, respectively, and a plurality of contact elements (not illustrated) disposed in inner terminal members 48.

The connectors 28 and 30 are arranged in a spaced back-to-back relation so that the terminal portions 44 and 46 are directed towards each other with a space 50 therebetween. The connectors 28 and 30 are secured in spaced relation by tubular stand-off members 52 and 54 which are mounted to and extend through the ledges 40 and 42. The stand-off members 52, 54 also function in securing the connector assembly 24 to a compatible connector member (not illustrated) as described below. In the preferred form, intermediate conductors 55 are disposed in the space 50 and interconnect corresponding contact elements of the connectors 28, 30, so that each of the conductors 12 is electrically coupled to at least one contact element in each connector 28, 30. The terminal portions 44 and 46 may also be directly secured together.

As previously described, the cable 10 includes two distinct and isolated circuit paths along the inner and outer shielding layers 16, 20, and to complete each circuit, each shield 16 and 20 must be electrically connected to ground along different paths. If the shielding layers 16 and 20 were to become electrically interconnected, such interconnection would preclude the electrical isolation between the layers 16 and 20 and thereby eliminate the separate shielding function of the inner layer 16 as well as the capacitance effect between the layers 16 and 20. To electrically connect the shielding layer 16 to ground, a drain wire 56 formed from electrically conductive material is provided. The drain wire 56 is preferably unraveled from the braided metal which constitutes the inner shield 16 so that the wire 56 is electrically and physically secured to the inner shield 16. The end of the drain wire 56 is then terminated to one of the contact elements within one of the connectors 28, 30, and this contact element thus becomes a ground element to be engaged to a similar contact element of a compatible connector member which is in turn eventually secured to ground. In this manner, the distinct EMI shielding of the layer 16 is extended throughout the entire connector assembly 24 and into the compatible connector member.

Referring to U.S. Pat. Application Ser. No. 958,979, the contents of which have been specifically incorporated herein by reference, and to FIG. 3, once the conductors 12 and the drain wire 56 have been terminated to the connectors 28, 30, an integrally molded protective enclosure 58 comprised of any suitable potting compound such as epoxy is molded between the connectors 28 and 30 so as to enclose the terminal portions 44 and 46 and the space 50 between the stand-offs 52 and 54. The protective enclosure 58 provides a strain relief coupling for the individual conductors 12 and 55 to the connector assembly 24 as well as provides support between the connectors 28 and 30. The potting compound of the enclosure 58 is intimately molded about the juxtaposed sides of the connectors 28 and 30 so that the resultant assembly is of a generally rectangular configuration having planar and generally parallel top and bottom surfaces defined by the potting compound.

Figure 4:
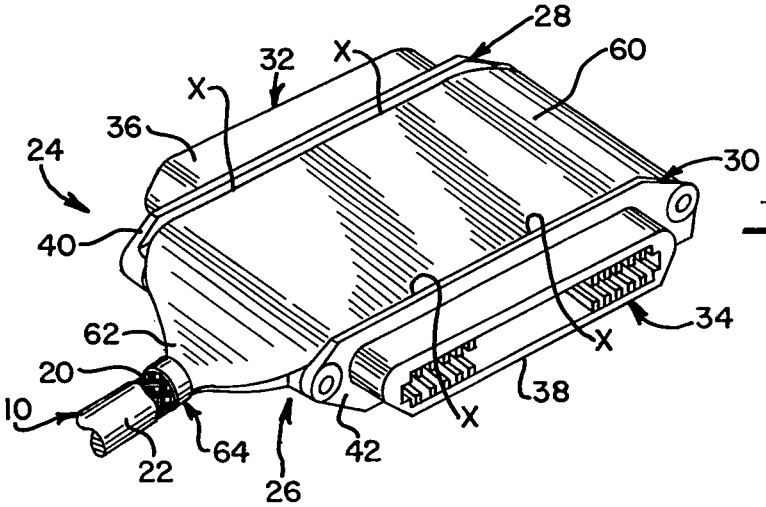
FIG. 4 is a perspective view similar to FIG. 3 but illustrating a third stage of assembly wherein the shielding means is positioned in the connector assembly and attached to the shielded cable.
Figure 5:
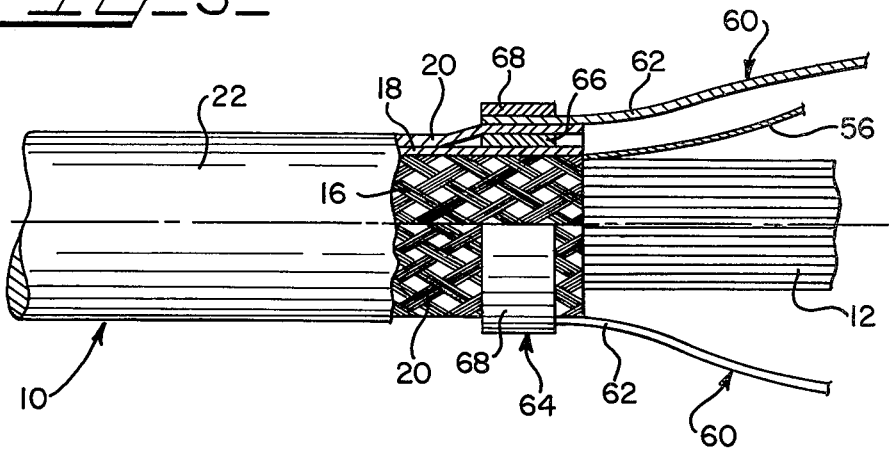
FIG. 5 is a partial cross-sectional view of the double EMI shielded cable of FIG. 1 terminated to a connector assembly and illustrating the shielding means attachment structure.

Referring to FIGS. 4 and 5, shielding means are provided for electrically connecting the outer shielding layer 20 to ground and for providing EMI and electrical shielding for the connector member 26. In the illustrated form, the shielding means preferably includes a single sheet of electrically conductive foil 60 which forms an envelope about the space 50, the protective enclosure 58, the terminal portions 44 and 46, and the stand-offs 52 and 54, so as to substantially surround the terminal portions 44 and 46 and the space 50 therebetween. The conductive sheet 60 is preferably constructed from a sheet of thin metal foil such as copper foil or the like. The sheet 60 is secured to the terminal portion of the cable 10 in the manner described below and is preferably spot-welded to the electrically conductive ledges 40 and 42 of the housings 36 and 38, respectively, at positions indicated by an "X" on both longitudinal sides of the connector member 26. Thus, the terminal portions 44 and 46 and the conductors 12 and 55 disposed therebetween are entirely surrounded by the conductive sheet 60 so as to shield them from electrical and electromagnetic radiation emanating from the surrounding environment.

The end portions 62 of the conductive sheet 60 are electrically and physically secured to the outer shielding layer 20 of the terminal portion of cable 10 by a crimping assembly 64. The crimping assembly 64 preferably includes a first annular member or ring 66 which is constructed from a hard metallic material such as brass and is sandwiched between the inner jacket 18 and the outer shielding layer 20. The first ring 66 separates the inner and outer shielding layers 16 and 20 and maintains their electrical separation by being isolated from the inner shielding layer 16 by the inner jacket 18. The end portions 62 of the shielding sheet 60 are then positioned over the terminal portion of the outer shielding layer 20 immediately above the first ring 66.

A second annular member or ring 68 constructed from a ductile material such as copper is positioned concentric with the first ring 66 immediately around the end portions 62. The second ring 68 is then crimped along its outer surface against the inner brass ring 66 so as to physically secure the end portions 62 against the outer shielding layer 20 and the brass ring 66. This crimping also insures proper electrical engagement between the shielding sheet 60 and the outer shielding layer 20. Thus, a ground path is established from the outer shielding layer 20 through the shielding sheet 60 to the housings 36 and 38 of the connectors 28 and 30. When the connector 28 or 30 is subsequently matingly engaged with a compatible connector member on a programmable instrument or the like, electrical engagement between the housings of the engaged connectors provides a circuit path for stray electromagnetic and electrical interference radiation received by the outer shielding layer 20 and the shielding sheet 60. In this manner, the two isolated shielding circuits provided by the layers 16 and 20 in the cable 10 are maintained throughout the entire connector assembly 24 so as to provide a total and continuous double shielding from EMI and electrical radiation.

Figure 6:
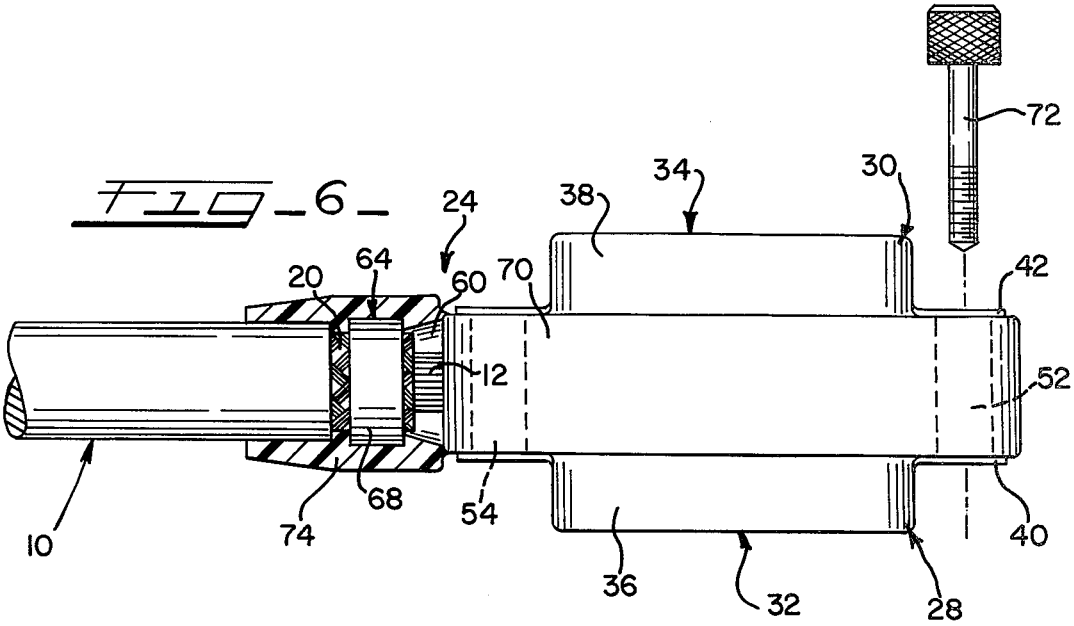
FIG. 6 is a side schematic, with some parts in section, of the assembled EMI shielded connector assembly of the present invention.
Figure 7:
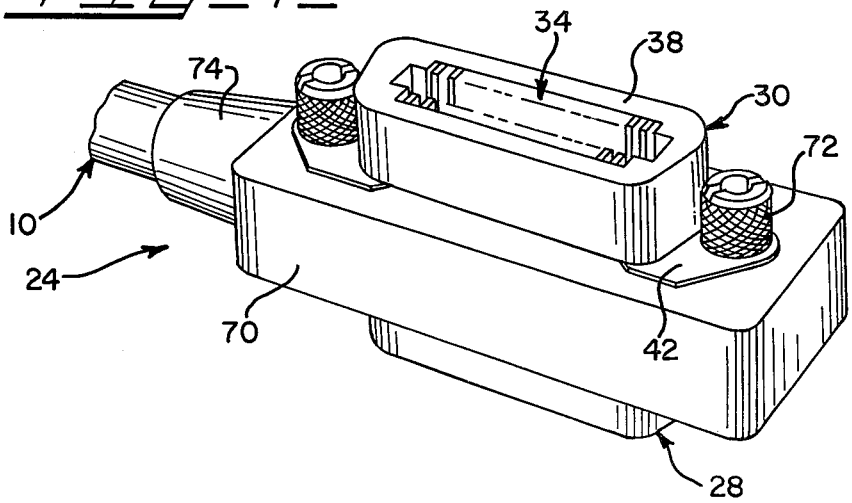
FIG. 7 is a perspective view of the fully assembled connector assembly of the present invention.

Referring to FIGS. 6 and 7, after the conductive shielding sheet 60 has been properly positioned in the connector assembly 24 and secured to the cable 10, an electrically insulating plastic housing 70 is conventionally molded about the sheet 60 to form an electrically insulating connector assembly base. The housing 70 is preferably molded so that the outer surfaces of the ledges 40 and 42 are disposed on the outer surfaces of the housing 70. In this manner, the stand-off members 52 and 54 provide apertures through which lock screws 72 may pass to mount the connector assembly 24 to a desired compatible connector member (not illustrated). In addition, a layer of electrically insulating material 74 extends from the housing 70 to envelope the crimping assembly 64 and the terminal portion of the cable 10 to provide protection from environmental contaminants and the like as well as electrically insulate the crimping assembly 64. Thus, the connector assembly 24 is entirely protected from the environment and provides total and continuous double EMI and electrical shielding for the electrical circuits passing through conductors 12 into the connectors 28 and 30.

It should be noted that the shielded back-to-back connector member 26 may also be utilized to terminate single shielded cables. In this form of the invention, the single shielding layer of such a cable is electrically connected to the conductive shielding sheet 60 of the connector member 26 in a manner similar to the previously described embodiment.

Therefore, the present invention provides a double-ended or feedthrough connector assembly which is electrically shielded from EMI and electrical radiation. In addition, the present invention provides a connector assembly capable of terminating a double EMI shielded cable and for maintaining the two isolated shielding circuits throughout the entire connector assembly, thereby providing total and continuous EMI shielding. The cable and connector assembly unit of the present invention is capable of achieving an attenuation level of two or three decibels, which attenuation and shielding capability is particularly desirable and even necessary in environments having a high intensity of EMI and electrical radiation. The connector assemblies of the present invention are also capable of meeting the IEEE specification Standard 48-1975 requirements, which make the present invention particularly suitable for use in interface systems for programmable instruments.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

What I claim is:

1. A shielded connector assembly comprising:

a connector member including an electrically conductive housing, a plurality of contact elements, a mating portion for engaging a compatible connector member, and a conductor receiving terminal portion;

a shielded electrical cable interconnected with said connector member and including a plurality of conductors and electrically isolated inner and outer EMI shielding layers surrounding said conductors, said conductors being terminated to said contact elements in said connector terminal portion;

means for electrically connecting said inner shielding layer with one of said contact elements;

shielding means electrically interconnecting said outer shielding layer and said electrically conductive housing and substantially surrounding said terminal portion for continuously shielding said connector means from electromagnetic interference; and means for mechanically securing said shielding means to said cable.

2. An EMI shielded double-ended connector assembly for terminating an electrical cable having a plurality of conductors and an EMI shielding layer surrounding said conductors, said assembly comprising:

a pair of connector members arranged in spaced back-to-back relation having a plurality of contact elements, mating portions for engaging compatible connector members, and spaced terminal portions for terminating said conductors to said contact elements;

intermediate conductors disposed between said terminal portions for interconnecting respective contact elements in said connector members;

EMI shielding means electrically connected to said EMI shielding layer and substantially surrounding said terminal portions for continuously shielding said connector members from electromagnetic interference; and means for mechanically securing said shielding means to said cable.

3. The double-ended connector assembly as described in claim 2, wherein said EMI shielding means comprises a sheet of electrically conductive material forming an envelope to substantially surround said spaced terminal portions with the ends of said conductive sheet being secured to said EMI shielding layer.

4. An EMI shielded double-ended connector assembly for terminating an electrical cable having a plurality of conductors and electrically isolated inner and outer EMI shielding layers surrounding said conductors, said assembly comprising:

a pair of multi-contact element connector members arranged in space back-to-back relation having mating portions for engaging compatible connector members and spaced terminal portions for terminating said conductors to said contact elements;

means for electrically connecting said inner EMI shielding layer to at least one of said contact elements;

EMI shielding means electrically connected to said outer shielding layer and substantially surrounding said terminal portions to continuously shield said connector members from electromagnetic interference; and means for mechanically securing said shielding means to said cable.

5. An EMI shielded double-ended connector assembly for terminating an electrical cable having a plurality of central conductors and electrically isolated inner and outer EMI shielding layers surrounding said conductors, said assembly comprising:

a pair of multi-contact element connector members arranged in spaced back-to-back relation having mating portions for engaging compatible connector members and spaced terminal portions for terminating said conductors to said contact elements;

a plurality of intermediate conductors disposed between said terminal portions for interconnecting respective contact elements in said connector members;

a ground conductor for electrically connecting said inner EMI shielding layer to one of said contact elements;

a sheet of electrically conductive material forming an envelope substantially surrounding said spaced terminal portions with the ends thereof being electrically engaged to said outer shielding layer, said electrically conductive sheet providing continuous EMI shielding of said spaced terminal portions; and first and second concentric annular members for mechanically securing said conductive sheet to said cable.

6. The double-ended connector assembly as described in claim 5, wherein said first annular member is interposed between said inner and outer EMI shielding layers and is electrically isolated from one of said shielding layers, and said second annular member is disposed about said outer shielding layer concentric with said first annular member, the ends of said conductive sheet being interposed between said outer shielding layer and said second annular member with said second annular member firmly securing said conductive sheet and said outer shielding layer against said first annular member.

7. An EMI shielded cable for use in environments having high intensity electrical and EMI radiation comprising:

a plurality of bundled conductors;

an inner layer of electrically conductive, EMI shielding material disposed about said bundled conductors;

a layer of electrically insulating material disposed about said inner EMI shielding layer;

an outer layer of electrically conductive, EMI shielding material disposed about said electrically insulating layer; and an outer electrically insulating sheath disposed about said outer EMI shielding layer, said inner and outer EMI shielding layers being electrically isolated from each other whereby said outer shielding layer provides overall protection for said conductors from environmental EMI and electrical radiation, and said inner shielding layer provides secondary protection for said conductors and prevents signal loss from said conductors, the separated inner and outer shielding layers providing a capacitance effect in said cable.

8. The shielded cable as described in claim 7, wherein an electrically insulating binding tape is wrapped around said bundled conductors between said conductors and said inner shielding layer, and wherein said electrically insulating material comprises polyvinyl chloride.

9. The shielded cable as described in claim 7, wherein each said shielding layer comprises a flexible, substantially cylindrical layer of braided electrically conductive metal.

10. The shielded cable as described in claim 9, wherein said braided metal comprises an alloy of tin and copper.

11. A connector assembly for terminating an electrical cable having at least one central conductor and electrically isolated inner and outer EMI shielding layers surrounding said conductor, said assembly comprising:

a connector member including a plurality of contact elements, a mating portion for engaging a compatible connector member, and a terminal portion for terminating each said central conductor to one of said contact elements;

means for electrically connecting said inner shielding layer to at least one other of said contact elements;

shielding means electrically connected to said outer shielding layer and substantially surrounding said terminal portion, said shielding means comprising a sheet of electrically conductive material disposed around said terminal portion with the end of said conductive material being secured to said outer shielding layer, said shielding means providing continuous EMI shielding from said outer shielding layer to said connector member; and means for mechanically securing said shielding means to said cable.

12. The connector assembly as described in claim 11, wherein said means for mechanically securing said conductive sheet to said cable comprises first and second annular members, said first annular member being interposed between said inner and outer EMI shielding layers and electrically isolated from one of said shielding layers, and said second annular member being disposed about said outer shielding layer concentric with said first annular member, the ends of said sheet being interposed between said outer shielding layer and said second annular member, and said second annular member firmly securing said conductive sheet and said outer shielding layer against said first annular member.

13. A connector assembly for terminating an electrical cable having at least one central conductor and electrically isolated inner and outer EMI shielding layers surrounding said conductor, said assembly comprising:

a connector member including a plurality of contact elements, a terminal portion for terminating each said central conductor to one of said contact elements and a pair of connectors disposed in spaced back-to-back relation with each said connector having a mating portion for engaging a compatible connector member and a terminal portion, said terminal portions of said pair of connectors being arranged adjacent each other;

means for electrically connecting said inner shielding layer to at least one other of said contact elements;

shielding means electrically connected to said outer shielding layer and substantially surrounding said terminal portions for continuously shielding said connector member from electrical and electromagnetic interference, said shielding means comprising a sheet of electrically conducting material forming an envelope to substantially surround said terminal portions of said pair of back-to-back connectors; and means for mechanically securing said shielding means to said cable.

14. A connector assembly for terminating an electrical cable having at least one central conductor and electrically isolated inner and outer EMI shielding layers surrounding said conductor, said assembly comprising:

a connector member including a plurality of contact elements, a mating portion for engaging a compatible connector member, and a terminal portion for terminating each said central conductor to one of said contact elements;

means for electrically connecting said inner shielding layer to at least one other of said contact elements;

shielding means electrically connected to said outer shielding layer and substantially surrounding said terminal portion for continuously shielding said connector member from electrical and electromagnetic interference;

means for mechanically securing said shielding means to said cable; and said mating portion of said connector member including an electrically conductive housing in electrical engagement with said shielding means and adapted for electrical contact with said compatible connector member to provide continuous EMI shielding from said cable through said connector member to said compatible connector member when said connector assembly is mateably engaged with said compatible connector member.

* * * * *